US009512628B2

(12) United States Patent
David et al.

(10) Patent No.: US 9,512,628 B2
(45) Date of Patent: Dec. 6, 2016

(54) CONCRETE DISPENSING BOOM FOR CONCRETE PUMPS

(71) Applicant: Putzmeister Engineering GmbH, Aichtal (DE)

(72) Inventors: Ciprian David, Böblingen (DE); Michael Neubert, Aichtal (DE); Peter Hasel, Filderstadt (DE)

(73) Assignee: Putzmeister Engineering GmbH (DE)

( * ) Notice: Subject to any disclaimer, the term of this patent is extended or adjusted under 35 U.S.C. 154(b) by 62 days.

(21) Appl. No.: 14/610,654

(22) Filed: Jan. 30, 2015

(65) Prior Publication Data

US 2015/0136266 A1 May 21, 2015

Related U.S. Application Data

(63) Continuation of application No. PCT/EP2013/065468, filed on Jul. 23, 2013.

(30) Foreign Application Priority Data

Aug. 2, 2012 (DE) ..... 10 2012 213 729

(51) Int. Cl.
*E04G 21/04* (2006.01)

(52) U.S. Cl.
CPC ..... *E04G 21/0445* (2013.01); *E04G 21/0427* (2013.01); *E04G 21/0436* (2013.01)

(58) Field of Classification Search
CPC ..... E04G 21/0445; E04G 21/0427; E04G 21/0436; E04G 21/0418; E04G 21/0463; E04G 21/04; B67D 9/02; Y10T 137/8807; Y10T 137/88078; Y10T 137/88086; Y10T 137/88094; Y10T 137/88102; B66C 23/64; F16L 3/01; F16L 3/015; F16L 3/02; F16L 3/08; F16L 3/1033; F16L 3/1066; F16L 3/12; F16L 3/1215
(Continued)

(56) References Cited

U.S. PATENT DOCUMENTS 3,942,554 A * 3/1976 Werner ..... B66C 23/18 137/615
4,519,768 A 5/1985 Murai et al.
(Continued)

FOREIGN PATENT DOCUMENTS

DE 2 205 922 A1 7/1973
DE 196 44 410 A1 4/1998
(Continued)

OTHER PUBLICATIONS

Corrected Version of English Translation of International Preliminary Report on Patentability, PCT/EP2013/065468, Feb. 12, 2015.
(Continued)

*Primary Examiner* — Michael R Reid
(74) *Attorney, Agent, or Firm* — Bose McKinney & Evans LLP

(57) ABSTRACT

A concrete dispensing boom for stationary and mobile concrete pumps has a plurality of boom arms, connected to one another at joints, and a concrete conveying line consisting of a plurality of pipe segments preferably connected to one another in an articulated manner via pipe bends and rotary couplings. Said pipe segments run along the individual boom arms and are attached to these boom arms. At least one of the boom arms has a hollow chamber profile which has at least two hollow chambers separated from one another by a separating wall, at least one of which chambers is a closed chamber and one is open at the periphery. The pipe segment allocated to the boom arm concerned is
(Continued)

disposed on the opening side outside, partially inside or inside the open hollow chamber.

15 Claims, 9 Drawing Sheets

(58) Field of Classification Search
USPC ..... 137/614–616.7
See application file for complete search history.

(56) References Cited

U.S. PATENT DOCUMENTS

| | | | | |
|---|---|---|---|---|
| 4,828,033 | A * | 5/1989 | Frison | B67D 7/002 137/615 |
| 6,786,233 | B1 | 9/2004 | Anderson et al. | |
| 2005/0011604 | A1* | 1/2005 | Anderson | B66C 23/64 156/173 |
| 2009/0252575 | A1* | 10/2009 | Fuegel | B66C 23/32 414/10 |

FOREIGN PATENT DOCUMENTS

| | | | |
|---|---|---|---|
| EP | 0 037 571 | A2 | 10/1981 |
| EP | 2 039 498 | B1 | 3/2011 |
| GB | 2 132 676 | A | 7/1984 |

OTHER PUBLICATIONS

English Translation of International Preliminary Report on Patentability, PCT/EP2013/065468, Feb. 12, 2015.

* cited by examiner

CONCRETE DISPENSING BOOM FOR CONCRETE PUMPS

RELATED APPLICATIONS

This application is a continuation of PCT/EP2013/065468, filed Jul. 23, 2013, which claims priority to DE 10 2012 213 729.7, filed Aug. 2, 2012, both of which are hereby incorporated herein by reference in their entireties.

BACKGROUND

The invention relates to a concrete dispensing boom for static and mobile concrete pumps, having multiple boom arms which are connected to one another at joints, and having a concrete delivery conduit which is composed of multiple pipe segments which are articulatedly connected to one another preferably by way of pipe bends and rotary couplings and which are guided along and fastened to the individual boom arms.

Known concrete dispensing booms have boom arms which are designed with a closed box profile or tubular profile (DE 196 44 410 A1). With a box profile or tubular profile of said type, it is possible to ensure good stability and torsional rigidity of the boom arms with a relatively low weight. A box profile or tubular profile has the disadvantage, however, that a concrete delivery conduit arranged in the interior of a profile of said type can be made accessible, for maintenance of the concrete delivery conduit, only with considerable outlay in terms of construction. However, if the concrete delivery conduit is led outside the boom arms, cumbersome pipe brackets are required in order to hold the concrete delivery conduit on the boom arms. Said pipe brackets entail additional weight which must be taken into consideration in the design of concrete dispensing booms.

SUMMARY

The present invention provides a concrete dispensing boom which exhibits good stability and torsional rigidity while having a simultaneously low inherent weight.

This is achieved by means of a concrete dispensing boom in which at least one of the boom arms has a hollow chamber profile with at least two elongate hollow chambers which are separated from one another by a partition and of which at least one is closed and one is circumferentially open, and wherein the pipe segment associated with the respective boom arm is arranged on the opening side outside, partially within or entirely within the open hollow chamber.

This disclosure is based on the concept that a boom arm which has a box profile, that is to say which has a rectangular cross section, can be produced, by joining together flange plates and side wall or web plates, with very high stability and in inexpensive fashion by virtue of the respective plates being welded together. A further concept of this disclosure is that a closed profile offers the advantage that the boom arm can be painted with only little outlay, and rust problems owing to ingress of water are avoided. A boom arm in box form can in particular also, with little outlay in terms of manufacture, be of cranked design, that is to say configured so as to be singly or multiply angled toward its sides. In the case of a concrete dispensing boom, said cranked configuration is necessary in the case of certain boom arms in order that these can move past one another during operation.

The concrete delivery conduit held on a boom arm, and the angled structural form of boom arms, have the result that the boom arms in a concrete dispensing boom are subject to considerable torsional moments. In the case of conventional concrete dispensing booms, such torsional moments are high inter alia because the cantilever construction of the pipe brackets increases said moments.

It is therefore a concept of this disclosure to adapt the cross section of the boom arms in a concrete dispensing boom to the local load on a boom arm. According to this disclosure, it is therefore proposed that, in the case of a boom arm of box-shaped form for a concrete dispensing boom, at least one of the side walls be set back. In this way, a circumferentially open cavity is created as additional structural space for the concrete delivery conduit, such that the concrete delivery conduit can be guided more closely along the boom arm. With these measures, it is possible in particular to reduce the lever forces with which the load of the concrete delivery conduit acts on a boom arm via the pipe brackets.

In the context of this disclosure, it is proposed in particular that the boom arm which has the hollow chamber profile be configured as a box with an upper flange and a lower flange, which box has a first side wall which is set back in relation to the upper flange and the lower flange and which has a second side wall which is spaced apart from the first side wall, wherein the upper flange and the lower flange together with the first side wall and the second side wall define the at least one closed hollow chamber, and the first side wall together with the upper flange and the lower flange form the circumferentially open hollow chamber. Said circumferentially open hollow chamber may for example have a trapezoidal, in particular rectangular or triangular cross section.

The second side wall, too, may be arranged so as to be set back in relation to the upper flange and the lower flange, and thus define a further circumferential hollow chamber. The cross section of said further circumferentially open hollow chamber may also be trapezoidal, in particular rectangular or triangular. The upper flange and the lower flange are preferably parallel to one another. The first side wall and/or the second side wall are/is in this case perpendicular to the upper flange and/or the lower flange. To optimize the torsional load profile in a boom arm, it is advantageous if the spacing of the first side wall from the second side wall varies across the boom arm.

The upper flange and/or the lower flange in a boom arm according to this disclosure may also protrude to different extents beyond the side wall of a boom arm in different regions, that is to say the upper flange and/or the lower flange may have a flange edge, the spacing of which from the first side wall and/or from the second side wall assumes different values in the longitudinal direction of the boom arm.

The first side wall and/or the second side wall may have an attachment section which can be pre-mounted on the upper flange and/or on the lower flange. With the attachment section that can be pre-mounted, it can be achieved that the side wall can be equipped with an attachment structure which can be screwed to the further boom arm sections.

A reduction of the torsion loading of a boom arm provided with a cranked configuration can be attained in particular if the concrete delivery conduit is led from one side of the boom arm to the opposite side of the boom arm through the first side wall and through the second side wall in the cranked section.

In this case, the concrete delivery conduit is fixed to the first side wall or to the second side wall by means of one or more pipe brackets, and may be arranged partially within or entirely within the open hollow chamber.

A boom arm with a hollow chamber profile may be composed at least partially of fiber-reinforced plastic (fiber composite plastic) or of metal.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

In this disclosure, terms such as "vertical," "perpendicular," "parallel," "horizontal," "longitudinal," "central," "rectangular" and the like are used to describe the orientation, position or general shape of structural elements disclosed herein. As would be readily recognized by one of ordinary skill, it shall be understood for purposes of this disclosure and claims that these terms are not used to connote exact mathematical orientations or geometries, unless explicitly stated, but are instead used as terms of approximation. With this understanding, the term "vertical," for example, certainly includes a structure that is positioned exactly 90 degrees from horizontal, but should generally be understood as meaning positioned up and down rather than side to side. Other terms used herein to connote orientation, position or shape should be similarly interpreted. Further, it should be understood that various structural terms used throughout this disclosure and claims should not receive a singular interpretation unless it is made explicit herein. By way of non-limiting example, the terms "chamber," "conduit," "boom arm," to name just a few, should be interpreted when appearing in this disclosure and claims to mean one or more. All other terms used herein should be similarly interpreted unless it is made explicit that a singular interpretation is intended.

Figure 1:
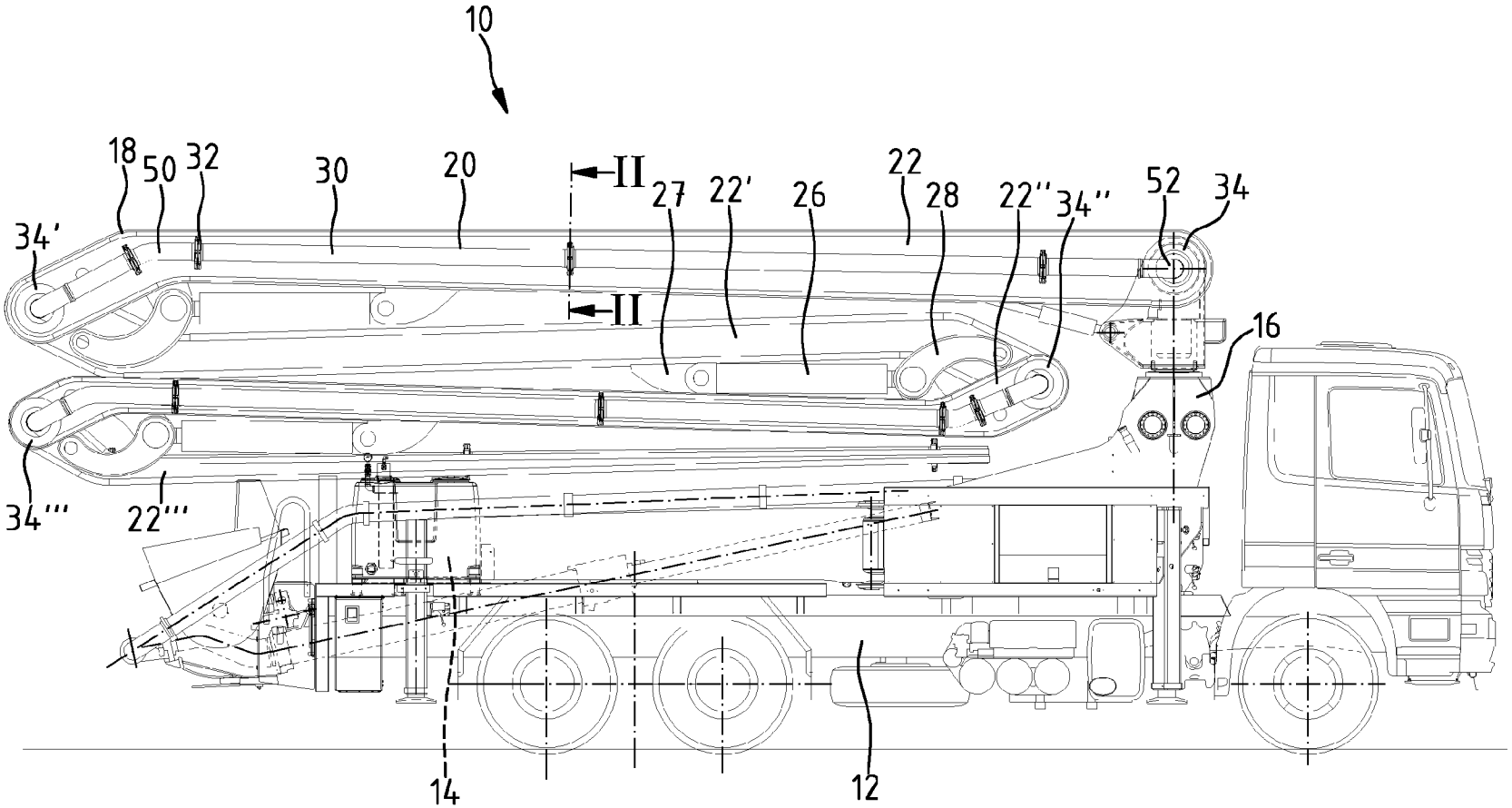
FIG. 1 shows a side view of an automotive concrete pump with a concrete dispensing boom.

The automotive concrete pump 10 in FIG. 1 has a chassis 12 with a substructure 14 which bears a concrete dispensing boom 18. The concrete dispensing boom 18 is mounted on the substructure 14 at a boom pedestal 16 and has rotary joints 34, 34', 34" and 34'" in which the boom arms 22, 22', 22" and 22'" can be moved about a horizontal axis of rotation. The concrete dispensing boom 18 is formed with a concrete delivery conduit 20 which has pipe bends 50 and pipe segments 30 which are articulatedly connected to one another by way of pipe couplings 32 and rotary couplings 52.

Figure 2:
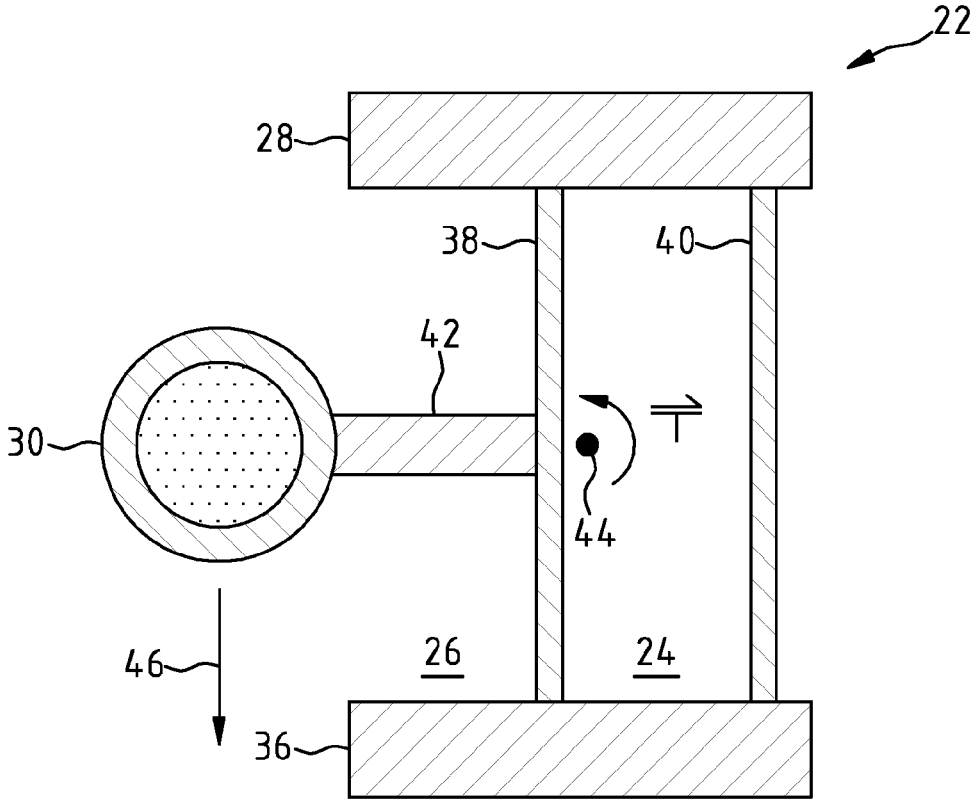
FIG. 2 shows a cross section through a boom arm in the concrete dispensing boom with a concrete delivery conduit.

FIG. 2 shows the boom arm 22 in cross section along the line II-II in FIG. 1. The boom arm 22 has a hollow chamber profile which has a closed, elongate hollow chamber 24 and a circumferentially open hollow chamber 26 which extends in the longitudinal direction. In other words, chamber 26 has an opening extending along its length or is open on one side, as is depicted in FIG. 2. The hollow chamber profile of the boom arm 22 is in the form of a box which has an upper flange 28 and a lower flange 36. The box has a first side wall 38 and a second side wall 40. The first side wall 38 is a partition in the hollow chamber profile. The upper flange 28 and the lower flange 36 are parallel to one another, wherein the first side wall and/or the second side wall are/is perpendicular to the upper flange and/or to the lower flange. The first side wall 38 is positioned so as to be set back in relation to the upper flange 28 and the lower flange 36.

That pipe segment 30 in the concrete dispensing boom 18 which is associated with the boom arm 22 is arranged outside the hollow chamber 26 on the opening side thereof. That is, pipe segment 30 is arranged outside of the opening extending along the length of chamber 26. It is pointed out that it is however basically also possible for the pipe segments 30 of the concrete delivery conduit 20 to be arranged partially within or even entirely within the open hollow chamber 26.

The pipe segment 30 is held on the boom arm 22 by means of a pipe bracket 42 which projects into the hollow chamber 26 and is fixed to the first side wall 38. By means of this measure, it can be achieved that the torsional moment introduced into the boom arm 22 via a pipe bracket 42 by the load of the concrete delivery conduit 20, which acts in accordance with the arrow 46, is minimized. The boom arms 22', 22" and 22'" in the concrete dispensing boom 18 shown in FIG. 1 also have a construction corresponding to the construction of the boom arm 22.

Figure 3:
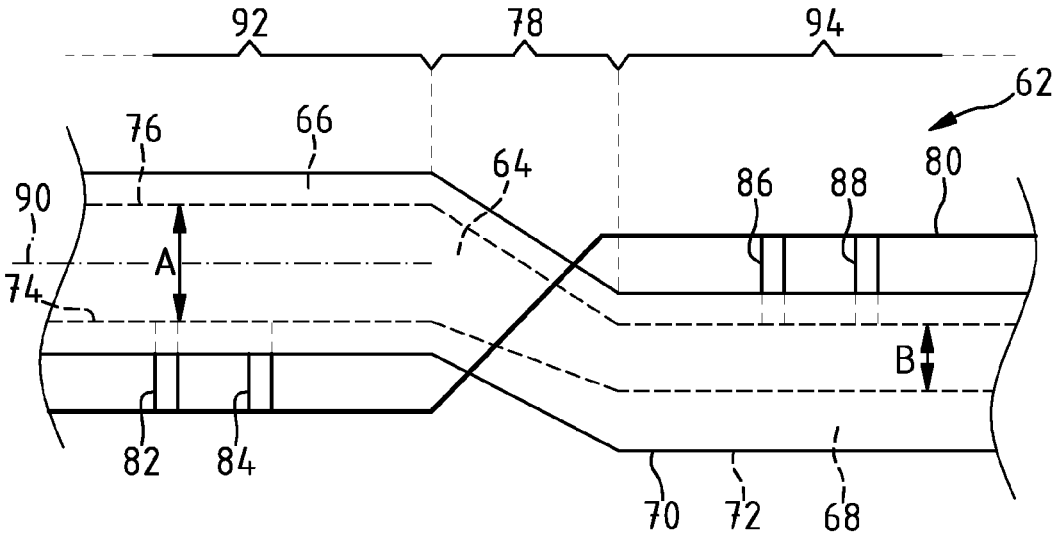
FIG. 3 shows a section of a further boom arm for a concrete dispensing boom, which has a cranked section and bears a concrete delivery conduit.

FIG. 3 shows a section of a further boom arm 62 for a concrete dispensing boom with a concrete delivery conduit 80. The boom arm 62 has a hollow chamber profile which has a closed elongate hollow chamber 64 and which comprises two circumferentially open hollow chambers 66, 68 which extend in the longitudinal direction. The hollow chamber profile of the boom arm 62 is also in the form of a box which has an upper flange 70 and a lower flange 72. The box has a first side wall 74 and a second side wall 76. The two side walls 74, 76 are partitions in the hollow chamber profile. The upper flange 28 and the lower flange 36 are parallel to one another, wherein the first side wall 74 and/or the second side wall 76 are perpendicular to the upper flange 70 and to the lower flange 72. It is however also possible in the case of a boom arm according to this disclosure to provide an upper flange and a lower flange which taper toward one another in conical fashion.

By contrast to the boom arm 22 shown in FIGS. 1 and 2, the boom arm 62 has a cranked section 78. The concrete delivery conduit 80 is fixed to the boom arm 62 by means of the pipe brackets 82, 84 on the first side wall 74 and by means of the pipe brackets 86, 88 on the second side wall 76. In the cranked section 78, the concrete delivery conduit is led from one side of the boom arm 62 to the opposite side of the boom arm 62 through the first side wall 74, the closed hollow chamber 64 and through the second side wall 76.

In the section 92, the spacing A of the first side wall 74 from the second side wall 76 is constant. In the section 78, the spacing between the first side wall 74 and the second side wall 76 decreases. In the section 94, the spacing B of the first side wall 74 from the second side wall 76 is defined by B<A. With this measure, the torsional resistance of the boom arm cross section is adapted across the boom arm 62 to the load thereof.

Figure 4:
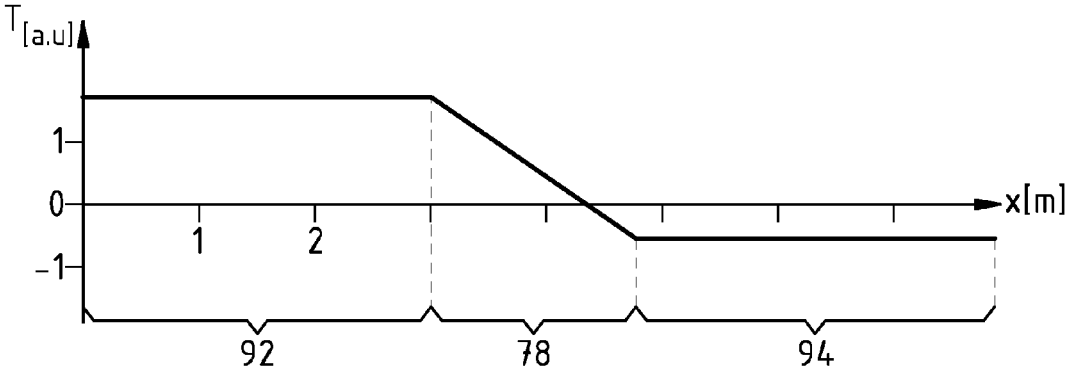
FIG. 4 shows a torsion load generated in the further boom arm by the concrete delivery conduit.

FIG. 4 shows, in relation to the line 90 of the common center of area of the upper and lower flanges 70, 72 in the boom arm section 92, the torsional load T introduced into the boom arm 62 by the load of the concrete delivery conduit 80. By virtue of the fact that the concrete delivery conduit 80 is led through the side walls 74, 76 of the boom arm 62, it can be achieved that the torsional moment T introduced into the boom arm 62 after the cranked section 78 at least partially compensates the torsional moment introduced into the boom arm 62 before the cranked section 78.

In the case of the boom arm 62, the side walls 74, 76 are designed for attachment to the upper flange 70 and the lower flange 72 by way of attachment sections 71 forming an attachment structure. Said attachment structure is designed such that, in the set-back position of the side walls 74, 76, a high-quality connection to the upper flange and lower flange 70, 72 is made possible. The sections of the side walls 74, 76 are then fixed to said attachment structure by screw connection or by welding.

Figure 5:
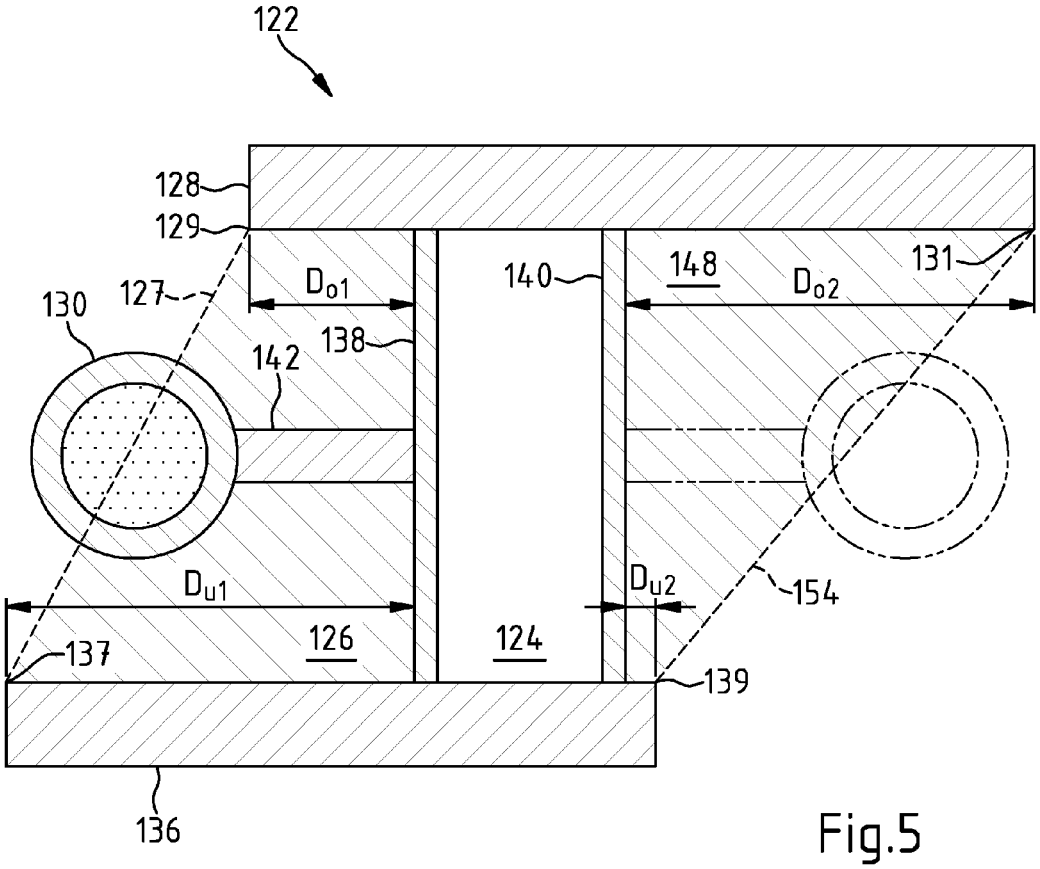
FIG. 5 to FIG. 8 show, in cross section, further boom arms of alternative construction for a concrete dispensing boom.

FIG. 5 shows a further boom arm 122, constructed alternatively to the boom arm 22, for a concrete dispensing boom in a cross section corresponding to the view of FIG. 2.

The boom arm 122 also has a hollow chamber profile which has a closed elongate hollow chamber 124 and a circumferentially open hollow chamber 126 which extends in the longitudinal direction. The hollow chamber profile of the boom arm 122 is likewise in the form of a box which has an upper flange 128 and a lower flange 136. The box has a first side wall 138 and a second side wall 140.

The upper flange 128 and the lower flange 136 are parallel to one another, wherein the first side wall and/or the second side wall 138, 140 are perpendicular to the upper flange and/or to the lower flange. In this case, the first side wall 138 is positioned so as to be set back in relation to the lower flange 136, and has the spacing $D_{U1}$ from the flange edge 137 on the side of the first side wall 138. By contrast, the flange edge 129 of the upper flange 128 on the side of the first side wall 138 has the spacing $D_{O1}<D_{U1}$.

The first side wall 138 is a partition in the hollow chamber profile. The second side wall 140 is also a partition in the hollow chamber profile. The second side wall 140 is positioned so as to be set back in relation to the upper flange 128 and has the spacing $D_{O2}$ from the flange edge 131 on the side of the first side wall 138. By contrast, the flange edge 139 of the lower flange 136 on the side of the second side wall 140 has the spacing $D_{U2}<D_{O2}$.

The upper flange 128 and the lower flange 136 together with the first side wall 138 form a circumferentially open hollow chamber 128 which has a cross section 127 in the form of a convex trapezoid. Together with the second side wall 140, the upper flange 128 and the lower flange 136 define a further hollow chamber 148 with a cross section 154 in the form of a convex trapezoid, said further hollow chamber likewise being circumferentially open.

The pipe segment 130, associated with the boom arm 122, of the concrete delivery conduit in the concrete dispensing boom 118 is arranged outside the hollow chamber 126 on the opening side thereof, and is fixed to the first side wall 138 by means of one or more pipe brackets 142. It is pointed out that it is however basically also possible for the pipe segments 130 of the concrete delivery conduit to be arranged partially within or even entirely within the open hollow chamber 126. It is furthermore possible for the pipe segments of the concrete delivery conduit to also be arranged on the side of the circumferentially open hollow chamber 148 of the boom arm 122, specifically either within or only partially within or else outside the circumferentially open hollow chamber 148.

It is furthermore pointed out that, in a further alternative embodiment of the boom arm, the first side wall 138 may be flush with the upper flange 128, or the second side wall 140 may be flush with the lower flange 136. In this case, the cross section 127 of the circumferentially open hollow chamber 126 has the form of a right-angled triangle. A corresponding situation applies to the circumferentially open hollow chamber 148.

Figure 6:
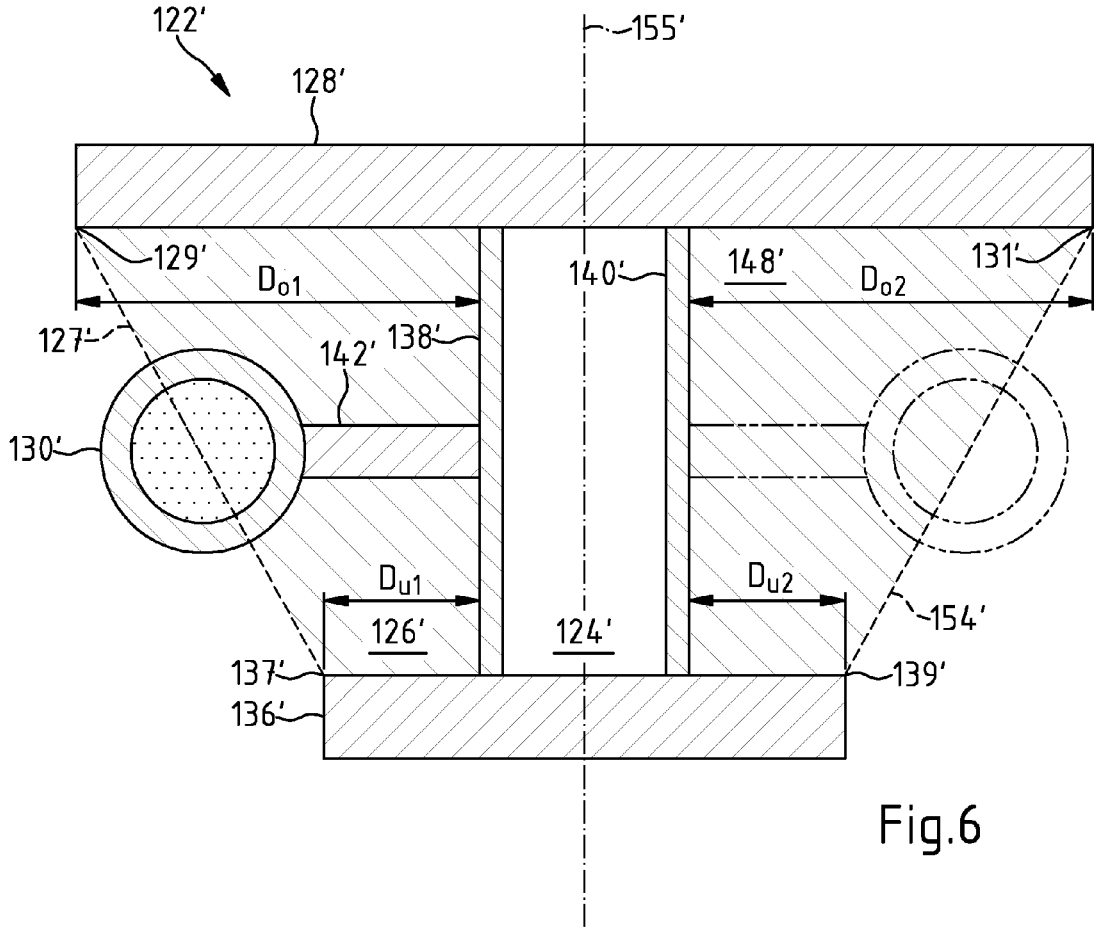
Figure 7:
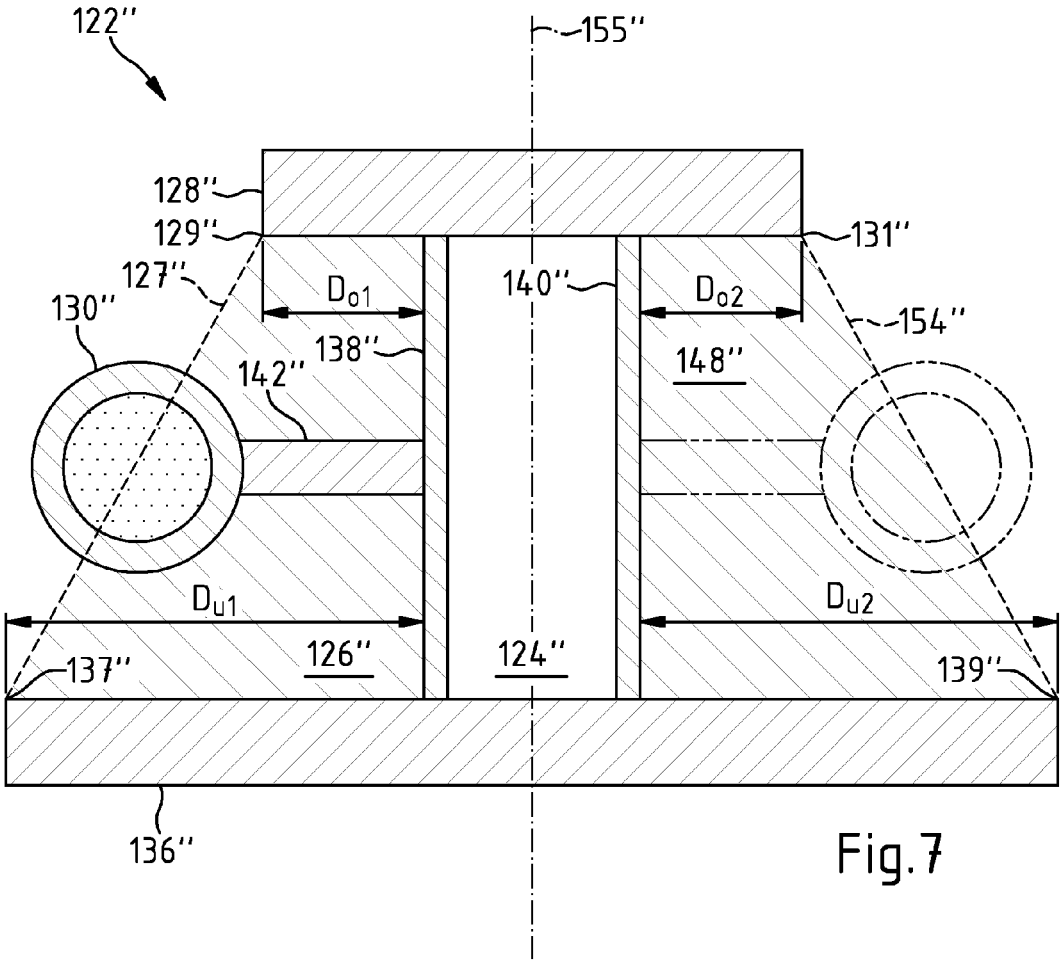
Figure 8:
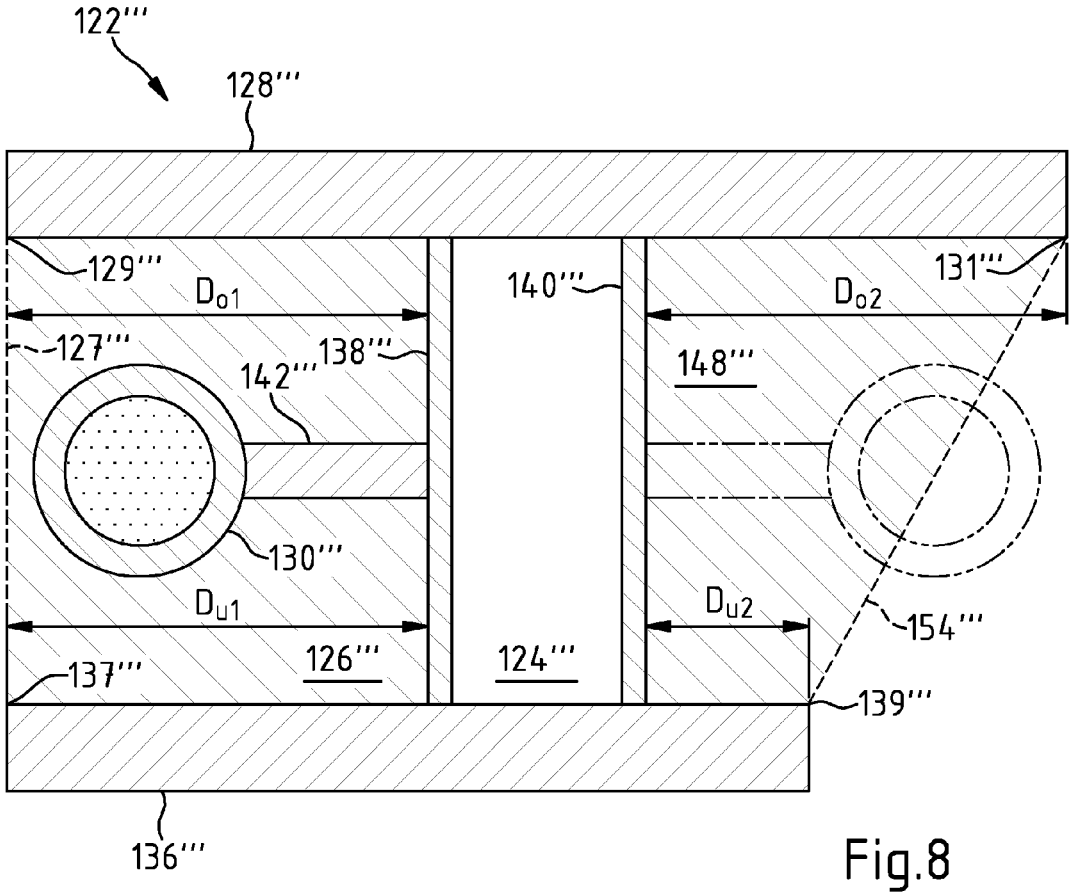

FIGS. 6 to 8 show further boom arms 122', 122", 122'" of alternative construction to the boom arm 22 for a concrete dispensing boom in a cross section corresponding to the view in FIG. 2. In this case, elements which functionally correspond to one another are denoted in FIGS. 5 to 9 using reference signs with the same numerals.

In the case of the boom arm 122' shown in FIG. 6, the upper flange 128' and the lower flange 136' are positioned symmetrically in relation to the axis of symmetry 155' of the hollow chamber 124. That is to say, for the spacing $D_{U1}$ of the flange edge 137' of the lower flange 136' and the spacing $D_{O1}$ of the flange edge 129' of the upper flange 128' from the first side wall 138', and for the spacing $D_{U2}$ of the flange edge 137' of the lower flange 136' and the spacing $D_{O2}$ of the flange edge 129' of the upper flange 128' from the first side wall 138', the following applies: $D_{O1}=D_{O2}>D_{U1}=D_{U2}$.

In the case of the boom arm 122" shown in FIG. 7, the flange edge 137" of the lower flange 136" and the flange edge 129" of the upper flange 128" have the spacing $D_{U1}>D_{O1}$ from the first side wall 138'. The flange edge 131" of the upper flange and the flange edge 139" of the lower flange 136" have in this case the spacing $D_{U2}>D_{O2}$ from the second side wall 140". In this case: $D_{O1}=D_{O2}<D_{U1}=D_{U2}$.

The boom arm 122'" shown in FIG. 8 has a circumferentially open hollow chamber 126'" with a pipe segment 130'" of a concrete delivery conduit arranged therein. In the case of the boom arm 122'", the flange edge 137'" of the lower flange 136'" and the flange edge 129'" of the upper flange have the spacing $D_{U1}=D_{O1}$ from the first side wall 138'". The flange edge 137'" of the lower flange 136'" and the flange edge 129'" of the upper flange have in this case the spacing $D_{U2}<D_{O2}$ from the second side wall 140'".

Figure 9:
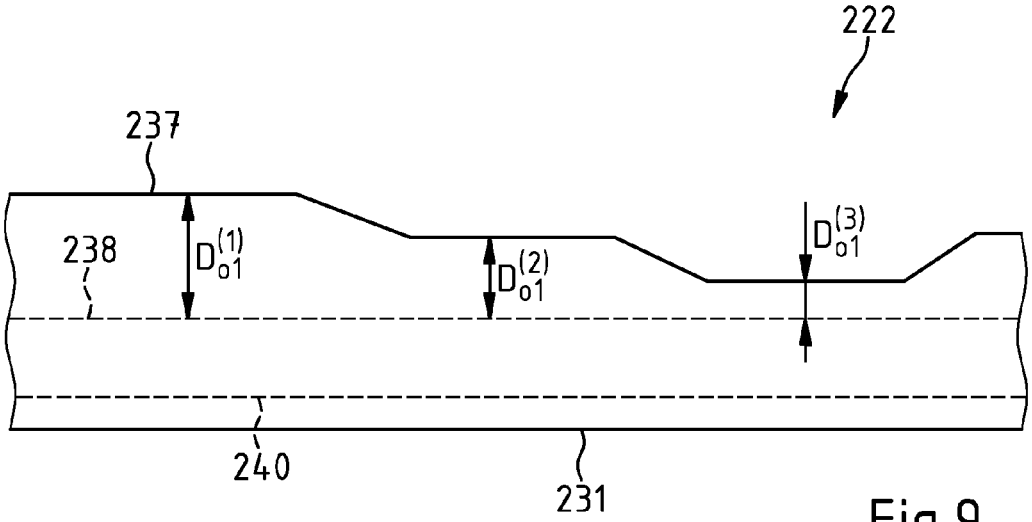
FIG. 9 and FIG. 10 show plan views of further boom arms for a concrete dispensing boom.

FIG. 9 shows a further boom arm 222 which is of alternative construction in relation to the boom arm 22 in FIG. 2 and which has a hollow chamber profile of box form with a circumferentially open hollow chamber and with a first and a second side wall 238, 240. In the case of the boom arm 222, the flange edge 237 of the upper flange has, over the longitudinal direction, the varying spacing $D_{O1}$ from the first side wall 238 corresponding to the values $D_{O1}^{(1)}$, $D_{O1}^{(2)}$, $D_{O1}^{(3)}$. The spacing of the flange edge 231 of the upper flange from the second side wall 240 is in this case constant over the longitudinal direction.

In an alternative embodiment according to this disclosure of the boom arm 222, it is possible for also the spacing $D_{U1}$ of the flange edge of the lower flange on the side of the first side wall 238, or only the spacing $D_{U1}$ of the flange edge of the lower flange, to assume different values along the longitudinal direction of the boom arm 222.

Figure 10:
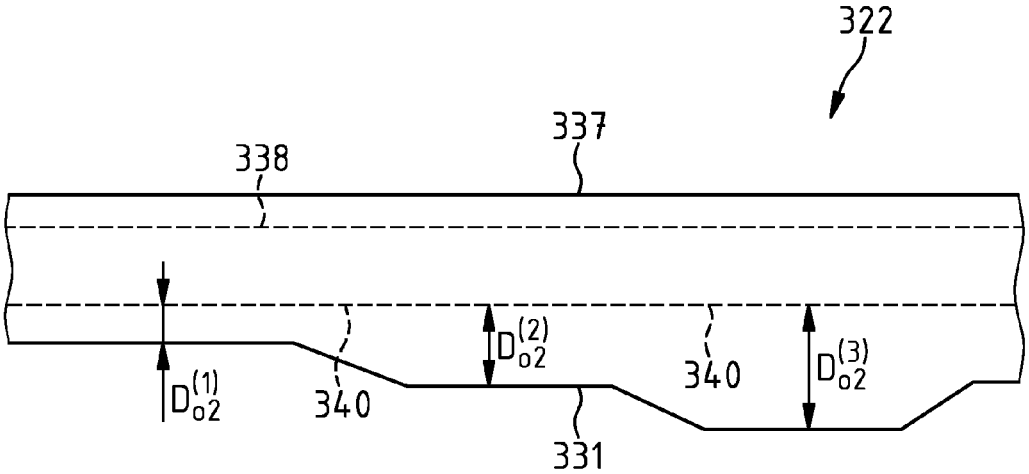
Figure 11:
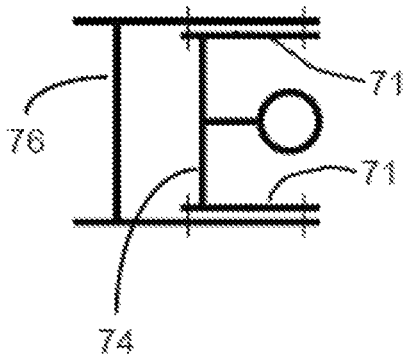
FIG. 11 is a schematic cross sectional view of a boom arm.

In the case of the boom arm 322 shown in FIG. 10, the upper flange and the lower flange together with a first and a second side wall 338, 340 likewise form a hollow chamber profile of box form, wherein in this case, the spacing $D_{U2}$ or $D_{O2}$ from the flange edge 331 of the upper flange to the second side wall 340 assumes different values $D_{O1}^{(1)}$, $D_{O1}^{(2)}$, $D_{O1}^{(3)}$ . . . over the longitudinal direction of the boom arm 322. It is pointed out that, in this case too, in an alternative embodiment according to this disclosure of the boom arm 322, the spacing $D_{U1}$ or $D_{O1}$ of the flange edge 337 of the lower flange or upper flange, respectively, on the side of the first side wall 338, the spacing $D_{U1}$ of the flange edge 331 of the lower flange on the side of the second side wall 340, or only the spacing $D_{U1}$ of the flange edge of the lower flange, may assume different values along the longitudinal direction of the boom arm 322.

With the embodiments for a boom arm in a concrete dispensing boom described above on the basis of FIG. 5 to FIG. 10, it can likewise be achieved that the torsional moment introduced into the boom arm by the load of the concrete delivery conduit via a pipe bracket is low.

It is pointed out that the hollow chamber profiles of the boom arms described above may be composed not only of metal but at least partially also of fiber composite plastic.

It is also pointed out that this disclosure also encompasses further modifications and refinements of concrete dispensing booms which arise from combination of different features of the exemplary embodiments described above.

In summary, the following can be stated: a concrete dispensing boom 18 for static and mobile concrete pumps has multiple boom arms 22 which are connected to one another at joints 34, and has a concrete delivery conduit 20 which is composed of multiple pipe segments 30 which are articulatedly connected to one another preferably by way of pipe bends 50 and rotary couplings 52 and which are guided along and fastened to the individual boom arms 22. At least one of the boom arms 22 has a hollow chamber profile with at least two hollow chambers 24, 26 which are separated from one another by a partition 40 and of which at least one is closed 24 and one 26 is circumferentially open. In this case, the pipe segment 30 associated with the respective boom arm 22 is arranged on the opening side outside, partially within or within the open hollow chamber 26.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE SIGNS

10 Automotive concrete pump
12 Chassis
14 Substructure
16 Boom pedestal
18 Concrete dispensing boom
20 Concrete delivery conduit
22, 22', 22", 22'" Boom arms
24 Closed hollow chamber
26 Circumferentially open hollow chamber
28 Upper flange
30 Pipe segment
32 Pipe coupling
34, 34', 34", 34'" Rotary joint
36 Lower flange
38 First side wall
40 Second side wall
42 Pipe bracket
44 Line
46 Arrow
50 Pipe bend
52 Rotary coupling
62 Boom arm
64 Hollow chamber
66 Hollow chamber
68 Hollow chamber
70 Upper flange
72 Lower flange
74 First side wall
76 Second side wall
78 Cranked section
80 Concrete delivery conduit
82 Pipe bracket
84 Pipe bracket
86 Pipe bracket
88 Pipe bracket
90 Line
92 Section
94 Section
118 Concrete dispensing boom
122, 122', 122", 122'" Boom arm
124, 124', 124", 124'" Closed, elongate hollow chamber
126, 126', 126", 126'" Open hollow chamber
127, 127', 127", 127'" Cross section
128, 128', 128", 128'" Upper flange
129, 129', 129", 129'" Flange edge of the upper flange
130, 130', 130", 130'" Pipe segment
131, 131', 131", 131'" Flange edge
136, 136', 136", 136'" Lower flange
137, 137', 137", 137'" Flange edge
138, 138', 138", 138'" First side wall
139, 139', 139", 139'" Flange edge
140, 140', 140", 140'" Second side wall
142, 142', 142", 142'" Pipe bracket
148, 148', 148", 148'" Circumferentially open hollow chamber
154, 154', 154", 154'" Cross section
155', 155" Axis of symmetry
222, 322 Boom arm
231, 331 Flange edge
237, 337 Flange edge
238, 338 First side wall
240, 340 Second side wall
$D_{U1}$ Spacing
$D_{U2}$ Spacing
$D_{O1}$ Spacing
$D_{O2}$ Spacing

What is claimed is:

1. A concrete dispensing boom for static and mobile concrete pumps, comprising:

multiple boom arms connected to one another at joints, the boom arms being positionable such that the boom arms extend at least partially in a horizontal direction;

a concrete delivery conduit comprising multiple pipe segments which are connected to one another by pipe bends and rotary couplings, the pipe segments being guided along and fastened to the individual boom arms;

one of the multiple boom arms having a profile defining two hollow chambers separated from one another by a partition, one of the two chambers being closed and the other chamber being open, wherein the pipe segment associated with the one boom arm is arranged outside, partially within or entirely within the open hollow chamber;

further wherein:

the open hollow chamber has a trapezoidal or triangular cross section;

the one boom arm has a box-shaped form;

the partition is set back in the open hollow chamber; and the partition comprises a first side wall and the one boom arm comprises a second side wall parallel to the first side wall, the second side wall delimiting the closed hollow chamber, the open hollow chamber being defined by the partition, laterally extending portions of the boom arm and a straight line extending from a laterally outer edge of the boom arm above the partition to a laterally outer edge of the boom arm disposed below the partition.

2. The concrete dispensing boom as claimed in claim 1, wherein the one boom arm is configured as a box with an upper flange and a lower flange and wherein the laterally outer edge of the boom arm above the partition is defined by the upper flange and the laterally outer edge of the boom arm disposed below partition is defined by the lower flange.

3. The concrete dispensing boom as claimed in claim 2, wherein the upper flange and the lower flange together with the first side wall and the second side wall define the closed hollow chamber, and the first side wall together with the upper flange and the lower flange form the open hollow chamber.

4. The concrete dispensing boom as claimed in claim 3, wherein the first side wall and/or the second side wall have/has an attachment section configured to be pre-mounted on the upper flange and/or on the lower flange.

5. The concrete dispensing boom as claimed in claim 3, wherein the concrete delivery conduit is led from one side of the boom arm to an opposite side of the boom arm through the first side wall and through the second side wall.

6. The concrete dispensing boom as claimed in claim 3, wherein the boom arm has a cranked section, and the concrete delivery conduit is led from one side of the boom arm to an opposite side of the boom arm through the first side wall and through the second side wall in the cranked section.

7. The concrete dispensing boom as claimed in claim 3, wherein the concrete delivery conduit is fixed to the first side wall or to the second side wall by one or more pipe brackets.

8. The concrete dispensing boom as claimed in claim 3, wherein the second side wall is set back in relation to the upper flange and the lower flange and, together with the upper flange and the lower flange and a straight line that extends from an edge of the upper flange to an edge of the lower flange, forms a further open hollow chamber.

9. The concrete dispensing boom as claimed in claim 8, wherein the further open hollow chamber has a trapezoidal or triangular cross section.

10. The concrete dispensing boom as claimed in claim 3, wherein the first side wall and/or the second side wall is perpendicular to the upper flange and/or to the lower flange.

11. The concrete dispensing boom as claimed in claim 3, wherein the spacing of the first side wall from the second side wall varies across the boom arm.

12. The concrete dispensing boom as claimed in claim 3, wherein the upper flange and/or the lower flange has a flange edge, the spacing of which from the first side wall and/or from the second side wall assumes different values in a longitudinal direction of the boom arm.

13. The concrete dispensing boom as claimed in claim 2, wherein the upper flange and the lower flange are arranged parallel to one another.

14. The concrete dispensing boom as claimed in claim 2, wherein the upper flange and the lower flange taper toward one another.

15. The concrete dispensing boom as claimed of claim 1, wherein the boom arm which has the hollow chamber profile is formed at least partially of a fiber composite plastic or of metal.

* * * * *